US009178263B1

(12) United States Patent
Podell

(10) Patent No.: US 9,178,263 B1
(45) Date of Patent: Nov. 3, 2015

(54) DIVIDER/COMBINER WITH BRIDGING COUPLED SECTION

(71) Applicant: Werlatone, Inc., Brewster, NY (US)

(72) Inventor: Allen F. Podell, Palo Alto, CA (US)

(73) Assignee: Werlatone, Inc., Patterson, NY (US)

( * ) Notice: Subject to any disclaimer, the term of this patent is extended or adjusted under 35 U.S.C. 154(b) by 0 days.

(21) Appl. No.: 14/473,767

(22) Filed: Aug. 29, 2014

(51) Int. Cl.
*H01P 5/16* (2006.01)
*H01P 3/08* (2006.01)

(52) U.S. Cl.
CPC ... *H01P 5/16* (2013.01); *H01P 3/08* (2013.01)

(58) Field of Classification Search
CPC ..... H01P 5/12; H01P 5/10; H01P 5/16; H01P 3/08
USPC ..... 333/4, 5, 26, 136, 238
See application file for complete search history.

(56) References Cited

U.S. PATENT DOCUMENTS

| | | | | |
|---|---|---|---|---|
| 3,091,742 | A | 5/1963 | Van Arragon | |
| 3,091,743 | A | 5/1963 | Wilkinson | |
| 3,516,025 | A | 6/1970 | Podell | |
| 3,529,265 | A | 9/1970 | Podell | |
| 3,761,843 | A | 9/1973 | Cappucci | |
| 3,883,828 | A | 5/1975 | Cappucci | |
| 3,988,705 | A | 10/1976 | Drapac | |
| 4,263,559 | A | 4/1981 | Ho | |
| 4,556,856 | A | 12/1985 | Presser | |
| 4,626,806 | A | 12/1986 | Rosar et al. | |
| 4,636,755 | A | 1/1987 | Gibbs | |
| 4,721,929 | A | 1/1988 | Schnetzer | |
| 4,851,795 | A | 7/1989 | Beckwith | |
| 5,206,611 | A | 4/1993 | Russell | |
| 5,847,625 | A | 12/1998 | Gillette | |
| 6,097,266 | A * | 8/2000 | Nardozza et al. | 333/101 |

(Continued)

FOREIGN PATENT DOCUMENTS

| | | | |
|---|---|---|---|
| CN | 101110610 | B | 11/2012 |
| GB | 2432462 | A | 5/2007 |

(Continued)

OTHER PUBLICATIONS

Cohn, Seymour B. "A Class of Broadened Three-Port TEM-Mode Hybrids." IEEE Transactions on Microwave Theory and Techniques. vol. MTT-16, No. 2. Feb. 1968, pp. 110-116.

(Continued)

*Primary Examiner* — Benny Lee
*Assistant Examiner* — Rakesh Patel
(74) *Attorney, Agent, or Firm* — Kolisch Hartwell, P.C.

(57) ABSTRACT

A divider may include a first node, a second node, a third node, at least a first divider section, and a first bridging assembly. The first divider section may include associated first and second transmission lines that respectively include first and second conductors that couple the first node to the second and third nodes. The first bridging assembly may include first and second resistors, and third, fourth, fifth, and sixth conductors. First ends of the third and fourth conductors may be respectively connected to the first and second conductors. Second ends of the third and fourth conductors may be grounded. The fifth and sixth conductors may be connected together and their opposite ends may be respectively terminated to ground by the first and second resistors. The third and fifth conductors may be closely inductively mutually coupled, and the fourth and sixth conductors may be closely inductively mutually coupled.

19 Claims, 4 Drawing Sheets

(56) References Cited

U.S. PATENT DOCUMENTS

| | | | | |
|---|---|---|---|---|
| 6,118,353 | A * | 9/2000 | McKay | 333/125 |
| 6,236,272 | B1 | 5/2001 | Takei et al. | |
| 6,300,848 | B1 | 10/2001 | Miyaji et al. | |
| 6,472,950 | B1 | 10/2002 | London | |
| 6,570,466 | B1 | 5/2003 | Bahl | |
| 6,822,531 | B2 | 11/2004 | Carlson | |
| 6,992,616 | B2 | 1/2006 | Grudkowski et al. | |
| 7,142,052 | B2 | 11/2006 | Zelley | |
| 7,663,449 | B2 | 2/2010 | Podell | |
| 2004/0263281 | A1 | 12/2004 | Podell | |
| 2005/0122185 | A1 | 6/2005 | Podell | |
| 2005/0122186 | A1 | 6/2005 | Podell | |
| 2005/0146394 | A1 | 7/2005 | Podell | |
| 2005/0156686 | A1 | 7/2005 | Podell | |
| 2006/0066418 | A1 | 3/2006 | Podell | |
| 2008/0018412 | A1 | 1/2008 | Podell | |

FOREIGN PATENT DOCUMENTS

| | | | |
|---|---|---|---|
| GB | 2440255 | A | 1/2008 |
| IL | 184629 | A | 6/2011 |
| TW | I447998 | B | 8/2014 |

OTHER PUBLICATIONS

Nagai, N., et al. "New n-Way Hybrid Power Dividers." Microwave Symposium Digest, 1977, IEEE MTT-S International Digital Object Indentifier. 1977, pp. 503-505.

Park, Ung-Hee, et al. "A 700-To 2500-MHz Microstrip Balun Using a Wilkinson Divider and 3-dB Quadrature Couplers." Microwave and Optical Technology Letters. vol. 47, No. 4. Nov. 20, 2005, pp. 333-335.

Shukla, et al. "Performance Analysis of Microstrip Ring Hybrid Power Divider." International Conference on Recent Trends in Engineering, Technology & Management, Bundelkhand Institute of Engineering & Technology, Jhansi, India. Feb. 27, 2011, 5 pages.

* cited by examiner

DIVIDER/COMBINER WITH BRIDGING COUPLED SECTION

BACKGROUND

The present disclosure relates to dividers/combiners, and in particular, to such dividers/combiners having an inductively uncoupled section with a bridging assembly across the outputs.

Dividers are circuits that divide a signal into a plurality of signals. An N-way divider divides a signal into N signals. Conversely, a combiner combines a plurality of signals into a single signal. The same circuit can be a divider or combiner, depending on the direction of current flow, i.e., whether the single port is an input port or an output port. As used herein, then, the use of the term "divider" also means "combiner".

In U.S. Pat. No. 3,091,743, Wilkinson disclosed a power divider in which one end of each of a plurality of branch lines are connected to a common node or port, and the other end of each line is connected to a second node via an interconnecting resistor. In the simple case of two branch lines, the two interconnecting resistors form an isolating interconnecting resistor that connects the two branch ends of the lines. In his article, A *Class of Broadband Three-Port TEM-Mode Hybrids, IEEE Transactions on Microwave Theory and Techniques*, Vol. MTT-16, No. 2, February 1968, Cohn extended the single section of Wilkinson to multiple cascaded sections formed of pairs of line lengths and interconnecting resistors. The increased number of sections resulted in improved VSWR, isolation, and bandwidth.

Two spaced-apart conductive lines are inductively coupled when they are spaced closely enough together for energy flowing in one to be induced in the other electromagnetically and/or electrostatically. The amount of energy flowing between the lines is related to the dielectric and magnetic media the conductors are in and the spacing between the lines. Even though electromagnetic fields surrounding the lines are theoretically infinite, lines are often referred to as being closely or tightly coupled, loosely coupled, or uncoupled, based on the relative amount of coupling. The amount of coupling may be defined by a coupling coefficient. However, as a practical measure, two lines may be considered to be inductively coupled when a detectable signal is coupled from one line onto the other. A threshold of coupling may be appropriate to distinguish between coupled and uncoupled lines. In most applications, two lines that have less than 20 dB inductive coupling between them are considered to be uncoupled lines. In some applications, lines that have less than 100 dB are considered to be uncoupled lines. In terms of a coupling coefficient, two lines may be considered to be closely coupled if the coupling coefficient is greater than 0.1. Thus, two lines may be considered as loosely coupled or substantially uncoupled if they have a coupling coefficient of less than 0.1.

SUMMARY

In some examples, a divider may comprise a first node, a second node, a third node, at least a first divider section, and a first bridging assembly. The first divider section may couple the first node to the second and third nodes. The first divider section may include associated first and second transmission lines. The first transmission line may include a first conductor having first and second ends. The second transmission line may include a second conductor having first and second ends. The first ends of the first and second conductors may be coupled to the first node. The second end of the first conductor may be coupled to the second node, and the second end of the second conductor may be coupled to the third node. The first bridging assembly may include first and second resistors, and third, fourth, fifth, and sixth conductors each having first and second ends. The first end of the third conductor may be connected to the second end of the first conductor, the first end of the fourth conductor may be connected to the second end of the second conductor, and the first end of the fifth conductor may be connected to the first end of the sixth conductor. The second ends of the third and fourth conductors may be grounded. The second end of the fifth conductor may be terminated to ground by the first resistor, and the second end of the sixth conductor may be terminated to ground by the second resistor. The third and fifth conductors may be closely inductively mutually coupled, and the fourth and sixth conductors may be closely inductively mutually coupled.

In some examples, the third and fourth conductors may be outer conductive shield portions of a coaxial transmission line, and the fifth and sixth conductors may be inner conductor portions of the coaxial transmission line.

In some examples, the divider may further comprise a conductive ground layer extending in a first plane, and the first, second, third, fourth, fifth, and sixth conductors may be included in one or more conductive layers extending in one or more planes parallel to and spaced apart from the first plane.

In some examples, the divider may include a second divider section that couples the first divider section to the second and third nodes. The second divider section may include associated third and fourth transmission lines. The third transmission line may include a seventh conductor that couples the second end of the first conductor to the second node, and the fourth transmission line may include an eighth conductor that couples the second end of the second conductor to the third node. The seventh and eighth conductors preferably are closely inductively coupled.

In some examples, the first and second conductors may be substantially inductively mutually uncoupled, and the seventh and eighth conductors may be closely inductively mutually coupled.

DETAILED DESCRIPTION

As stated previously, two lines are inductively coupled when a detectable signal is inductively coupled from one line onto the other. The amount of coupling may be selected for a particular application. The term divider also means combiner, since the same circuit may be used for either application depending on which ports a signal is (or signals are) applied. Further, circuit elements are considered to be directly connected when there are no intervening elements between them. Correspondingly, circuit elements are considered to be indirectly connected when there are intervening elements between them.

A divider may comprise a first node, a second node, a third node, at least a first divider section, and a first bridging assembly. The first divider section may couple the first node to the second and third nodes. The first divider section may include associated first and second transmission lines. The first transmission line may include a first conductor having first and second ends. The second transmission line may include a second conductor having first and second ends. The first ends of the first and second conductors may be coupled to the first node. The second end of the first conductor may be coupled to the second node, and the second end of the second conductor may be coupled to the third node. The first bridging assembly may include first and second resistors, and third, fourth, fifth, and sixth conductors each having first and second ends. The first end of the third conductor may be connected to the second end of the first conductor, the first end of the fourth conductor may be connected to the second end of the second conductor, and the first end of the fifth conductor may be connected to the first end of the sixth conductor. The second ends of the third and fourth conductors may be grounded. The second end of the fifth conductor may be terminated to ground by the first resistor, and the second end of the sixth conductor may be terminated to ground by the second resistor. The third and fifth conductors may be closely inductively mutually coupled, and the fourth and sixth conductors may be closely inductively mutually coupled.

Figure 1:
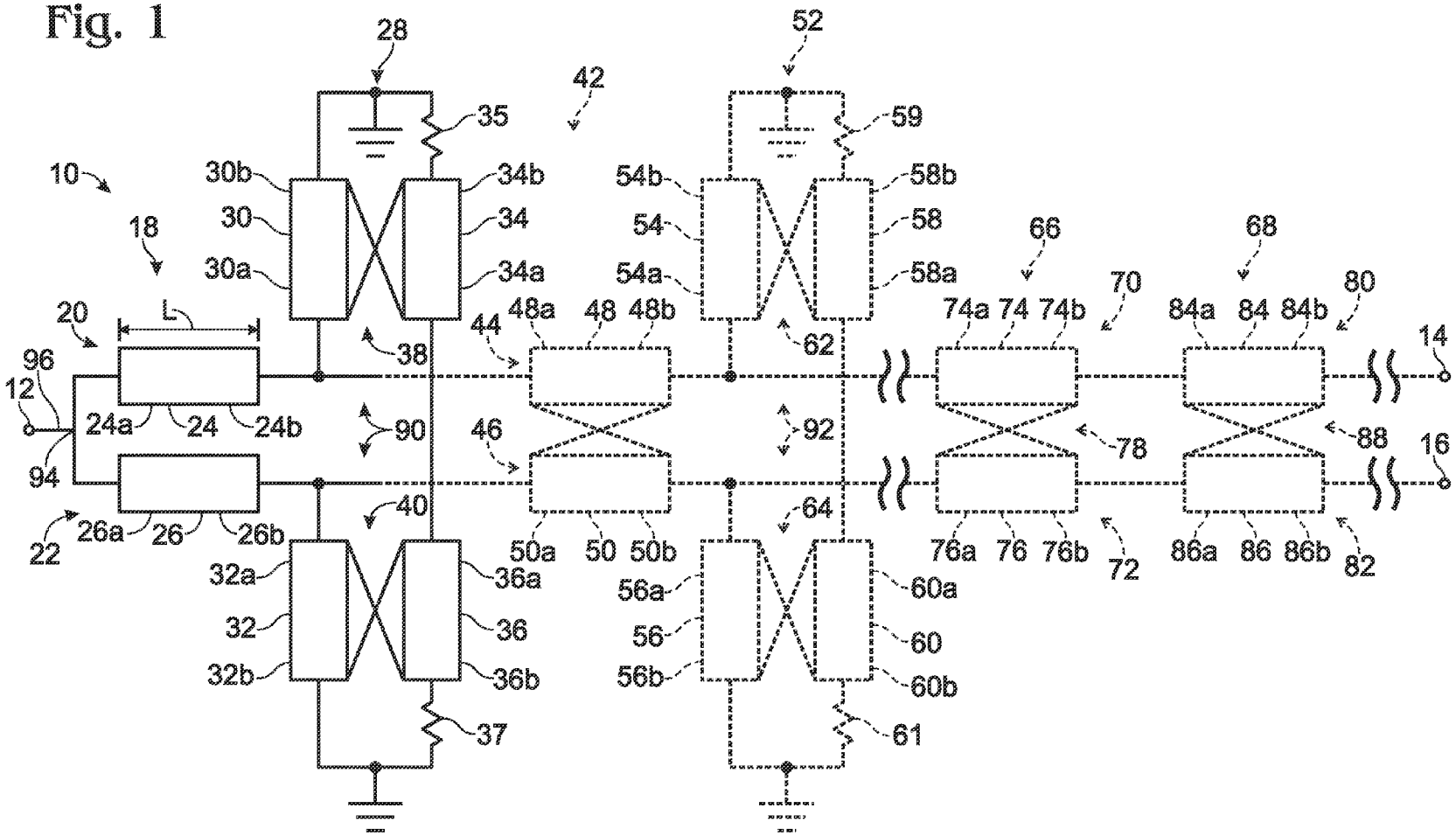
FIG. 1 is a schematic diagram of a divider including at least an uncoupled divider section and a bridging assembly, with additional optional sections and a bridging assembly shown in dashed lines.

Referring initially to FIG. 1, such a divider is shown generally at 10. Divider 10 may include a single first port or first node 12 and two or more branch ports or nodes, such as a second node 14 and a third node 16. When used as a divider, first node 12 may be referred to as an input port and second and third nodes 14, 16 may be referred to as output nodes. A node is a junction between circuit elements where circuit characteristics may be characterized, whether or not the node is physically accessible in any particular embodiment.

At least a first divider section 18 may couple node 12 to nodes 14, 16. Divider section 18 may include associated transmission lines 20, 22. Transmission line 20 may include a conductor 24, and transmission line 22 may include a conductor 26. Conductors 24, 26 may be substantially inductively mutually uncoupled. Conductors 24, 26 may be considered signal conductors, it being understood that the transmission lines also have signal-return conductors, such as a circuit ground, not shown.

First ends 24*a*, 26*a* of respective conductors 24, 26 may be coupled to node 12. For example, first ends 24*a*, 26*a* may be directly connected to node 12. A second end 24*b* of conductor 24 may be coupled to node 14, and a second end 26*b* of conductor 26 may be coupled to node 16.

Divider 10 may include a first bridging assembly 28 connected across an output end of divider section 18, the first bridging assembly including conductors 30, 32, 34, 36, and resistors 35, 37. A first end 30*a* of conductor 30 may be connected to second end 24*b* of conductor 24. A first end 32*a* of conductor 32 may be connected to second end 26*b* of conductor 26. A first end 34*a* of conductor 34 may be connected to a first end 36*a* of conductor 36. Second ends 30*b*, 32*b* of respective conductors 30, 32 may be grounded. Second end 34*b* of conductor 34 may be terminated to ground by resistor 35, and second end 36*b* of conductor 36 may be terminated to ground by resistor 37. Conductors 30, 34 may be closely inductively mutually coupled, and conductors 32, 36 may be closely inductively mutually coupled.

Conductors 30, 34 may form a transmission line 38, and conductors 32, 36 may form a transmission line 40. Transmission lines 20, 22, 38, 40 and resistors 35, 37 may have respective impedances that are configured to provide substantially equal output signals on nodes 14, 16 for a given input signal having a given frequency input on node 12, and an output impedance at each of nodes 14 and 16 substantially equal to the impedance of a respective externally connected load.

Optionally, divider 10 may include a plurality of divider sections including divider section 18 and a divider section 42 (shown in dashed lines) that couples divider section 18 to nodes 14, 16. As shown, divider section 42 may be similar to divider section 18, with divider section 42 including associated transmission lines 44, 46. Transmission lines 44, 46 may include respective conductors 48, 50. Conductors 48, 50 may be substantially inductively mutually closely coupled, as is described in U.S. Pat. No. 7,663,449, which patent is incorporated herein. First ends 48*a*, 50*a* of respective conductors 48, 50 may be coupled to node 12 through respective conductors 24, 26. A second end 48*b* of conductor 48 may be coupled to node 14. A second end 50*b* of conductor 50 may be coupled to node 16. Conductor 48 may couple second end 24*b* of conductor 24 to node 14, and conductor 50 may couple second end 26*b* of conductor 26 to node 16. In some examples, conductors 48, 50 may not be inductively closely coupled, although this may result in a divider that has a more limited bandwidth.

Optionally, divider 10 may include a second bridging assembly 52. As shown, assembly 52 may be similar to assembly 28. For example, assembly 52 may include conductors 54, 56, 58, 60 and resistors 59, 61. Impedances of resistors 59, 61 may be substantially equal to one another. A first end 54*a* of conductor 54 may be connected to second end 48*b* of conductor 48. A first end 56*a* of conductor 56 may be connected to second end 50*b* of conductor 50. A first end 58*a* of conductor 58 may be connected to a first end 60*a* of conductor 60. Second ends 54*b*, 56*b* of respective conductors 54, 56 may be grounded, and second ends 58*b*, 60*b* of respective conductors 50, 60 may be terminated to ground by respective resistors 59, 61. Conductors 54, 58 may be closely inductively mutually coupled, and may form a transmission line 62. Conductors 56, 60 may be closely inductively mutually coupled, and may form a transmission line 64.

Optionally, divider 10 may include one or more coupled divider sections, such as divider sections 66, 68, that couple divider section 18 and/or divider section 42 to nodes 14, 16.

Divider section 66 may include associated transmission lines 70, 72. Transmission line 70 may include a conductor 74. Conductor 74 may couple second end 24*b* of conductor 24 and/or second end 48*b* of conductor 48 to node 14. For example, a first end 74*a* of conductor 74 may be connected to second end 48*b* of conductor 48, and a second end 74*b* of conductor 74 may be connected to node 14. Transmission line 72 may include a conductor 76. Conductor 76 may couple second end 26*b* of conductor 26 and/or second end 50*b* of conductor 50 to node 16. For example, a first end 76*a* of conductor 76 may be connected to second end 50*b* of conductor 50, and a second end 76*b* of conductor 76 may be connected to node 16. Conductors 74, 76 may be closely inductively mutually coupled, and may form a transmission line 78.

Divider section 68 may include associated transmission lines 80, 82. Transmission line 80 may include a conductor 84. Conductor 84 may couple second ends 24*b*, 48*b*, and/or 74*b* of respective conductors 24, 48, 74 to node 14. For example, a first end 84*a* of conductor 84 may be connected to second end 74*b* of conductor 74, and a second end 84*b* of conductor 84 may be connected to node 14. Transmission line 82 may include a conductor 86. Conductor 86 may couple second ends 26*b*, 50*b*, and/or 76*b* of respective conductors 26, 50, 76 to node 16. For example, a first end 86*a* of conductor 86 may be connected to second end 76*b* of conductor 76, and a second end 86*b* of conductor 86 may be connected to node 16. Conductors 84, 86 may be closely inductively mutually coupled, and may form a transmission line 88.

Divider sections in which the associated transmission lines are substantially mutually inductively uncoupled may be referred to as uncoupled divider sections, or simply uncoupled sections. Similarly, divider sections in which the associated transmission lines are substantially mutually inductively coupled may be referred to as coupled divider sections, or simply coupled sections. The electrical lengths L of the transmission lines in the various examples are typically 90 degrees or a quarter of a wavelength ($\lambda/4$) at a design frequency, although the lengths may be different in specific applications. Each transmission line also has impedance, and in the case of coupled transmission lines, the lines will have even-mode impedance and odd-mode impedance.

Bridging assembly 28 may be located between divider section 18 and divider section 42. First end 30*a* of conductor 30 may be connected to second end 24*b* of conductor 24 in a junction region 90. In an example in which divider section 42 is included in the divider, divider section 18 is joined to divider section 42 in junction region 90. For example, junction region 90 may be a region where first end 48*a* of conductor 48 is joined (or electrically connected) to second end 24*b* of conductor 24, and/or where first end 50*a* of conductor 50 is joined (or electrically connected) to second end 26*b* of conductor 26. Similarly, first end 32*a* of conductor 32 may be connected to second end 26*b* of conductor 26 in junction region 90.

Bridging assembly 52 may be located between divider section 42 and divider section 66. First end 54*a* of conductor 54 may be connected to second end 48*b* of conductor 48 in a junction region 92. For example, junction region 92 may be a region where first end 74*a* of conductor 74 is joined (or electrically connected) to second end 48*b* of conductor 48, and/or where first end 76*a* of conductor 76 is joined (or electrically connected) to second end 50*b* of conductor 50. Similarly, first end 56*a* of conductor 56 may be connected to second end 50*b* of conductor 50 in junction region 92.

Respective conductors 24, 48, 74, 78 of transmission lines 20, 44, 70, 80 may be electrically connected in series with (and/or between) nodes 12, 14 when the respective divider sections are included in the divider. Similarly, respective conductors 26, 50, 76, 86 of transmission lines 22, 46, 72, 82 may be electrically connected in series with (and/or between) nodes 12, 16 when the respective divider sections are included in the divider.

It will be appreciated that in the embodiments illustrated in FIG. 1, bridging assemblies are positioned across the ends of uncoupled divider sections proximal nodes 14 and 16, and no bridging assemblies or other impedance devices are connected across the ends of coupled divider sections proximal nodes 14 and 16.

First ends 24*a*, 26*a* of respective conductors 24, 26 may be connected together at a connection 94 to a single conductor 96. Conductor 96 may be connected to or may form first node 12 of divider 10.

As shown in FIG. 1, bridging assemblies 28 and 52 of divider 10 may include grounded terminations. A bridging assembly may include a series combination of two transmission lines (e.g., transmission lines 38, 40) which are grounded at opposite ends and are connected across transmission lines (e.g., transmission lines 20, 22) that couple node 12 to nodes 14, 16. This structure allows heat occurring on the divider section conductors, such as conductors 24, 26, 48, 50, 74, 76, 84, 86, a thermally conductive path to ground via conductors 30, 32, 54, 56.

Figure 2:
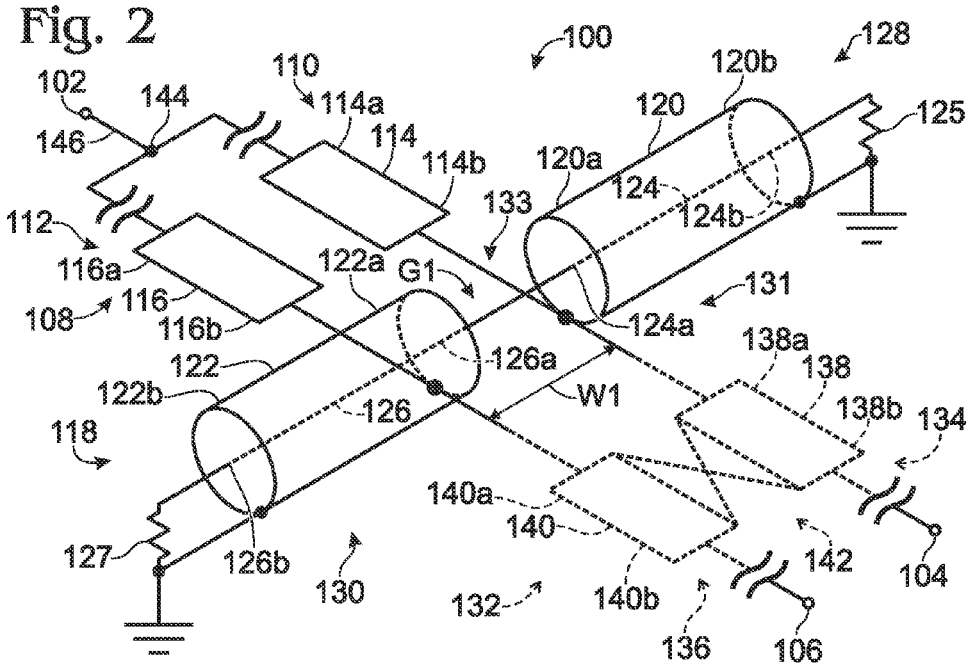
FIG. 2 is a semi-schematic diagram of a divider including an uncoupled divider section and a coaxial transmission line embodiment of a bridging assembly.

FIG. 2 shows a divider, generally indicated at 100. Divider 100 may be an embodiment of divider 10 of FIG. 1. Divider 100 may include a first node 102, a second node 104, a third node 106, and at least a first divider section 108 coupling node 102 to nodes 104, 106.

Divider section 108 may be similar to either of divider sections 18 or 42 of FIG. 1. For example, divider section 108 may include associated transmission lines 110, 112. Transmission line 110 may include a conductor 114, and transmission line 112 may include a conductor 116. Conductors 114, 116 may be substantially inductively mutually uncoupled to one another.

First ends 114*a*, 116*a* of respective conductors 114, 116 may be coupled to node 102. A second end 114*b* of conductor 114 may be coupled to node 104, and a second end 116*b* of conductor 116 may be coupled to node 106.

Divider 100 may include a bridging assembly 118, which may be an example of either of bridging assemblies 28 or 52 of FIG. 1. Bridging assembly 118 may include conductors 120, 122, 124, 126 and resistors 125, 127. Impedances of resistors 125, 127 may be substantially equal to one another.

Conductor 120 may be an outer conductive shield of a first coaxial transmission line portion 128, and conductor 124 may be an inner conductor of first coaxial transmission line portion 128. Conductor 122 may be an outer conductive shield of a second coaxial transmission line portion 130, and conductor 126 may be an inner conductor of second coaxial transmission line portion 130. Portion 128 and portion 130 may extend in divergent directions, such as in opposite directions from conductors 114 and 116, as shown.

Portions 128, 130 may be portions of a single, combined coaxial transmission line 131. Conductors 120, 122 may be respective first and second conductive shield portions of the combined coaxial transmission line. Conductors 124, 126 may be respective first and second inner conductor portions of the combined coaxial transmission line.

A first end 120*a* of shield 120 may be connected to second end 114*b* of conductor 114 in a connection region 133. A first end 122*a* of shield 122 may be connected to second end 116*b* of conductor 116. A first end 124*a* of inner conductor 124 may be connected to a first end 126*a* of inner conductor 126. Second ends 120*b*, 122*b*, of respective shields 120, 122 may be grounded, and second ends 124*b*, 126*b* of respective inner conductors 124, 126 may be terminated to ground by respective resistors 125, 127. Shield 120 and inner conductor 124 may be closely inductively mutually coupled to one another. Shield 122 and inner conductor 126 may be closely inductively mutually coupled to one another.

Adjacent ends 120*a*, 122*a* of respective shield portions 120, 122 may be spaced apart from one another to define a gap G1 in connection region 133 there between that may electrically conductively isolate shield portions 120, 122 from one another. Gap G1 may have a width W1. Inner conductors 124, 126 may be sections of a continuous inner conductor 131 of coaxial transmission line 131 that spans gap G1.

Optionally, divider 100 may include a divider section 132. Divider section 132 may couple divider section 108 to nodes 104, 106. Divider section 132 may be an example of either of divider sections 66 or 68 of FIG. 1.

Divider section 132 may include associated transmission lines 134, 136. Transmission line 134 may include a conductor 138. Conductor 138 may couple second end 114*b* of conductor 114 to node 104. In particular, a first end 138*a* of conductor 138 may be connected to second end 114*b* of conductor 114, and a second end 138*b* of conductor 138 may be connected to node 104. Transmission line 136 may include a conductor 140. Conductor 140 may couple second end 116*b* of conductor 116 to node 106. In particular, a first end 140*a* of conductor 140 may be connected to second end 116*b* of conductor 116, and a second end 140*b* of conductor 140 may be connected to node 106. Conductors 138, 140 may be closely inductively mutually coupled, and may form a transmission line 142.

As with divider 10, bridging assembly 118 of divider 100 is positioned across the ends of uncoupled divider section 108 proximal nodes 104 and 106, and no bridging assembly or other impedance device is connected across the ends of coupled divider section 132 proximal nodes 104 and 106.

Width W1 of gap G1 may be relatively narrow such that ends 120*a*, 122*a* of respective shields 120, 122 are relatively close to one another. For example, width W1 may correspond with (or be substantially equal to) a width of a gap defined between closely inductively mutually coupled conductors 138, 140. Alternatively, width W1 may be relatively wide such that ends 120*a*, 122*a* of respective shields 120, 122 are relatively far apart from one another. For example, width W1 may correspond with (or be substantially equal to) a width of a gap defined between substantially inductively mutually uncoupled conductors 114, 116.

It should be noted that FIG. 2 is a schematic representation of divider 100, and thus distances shown in FIG. 2 are not necessarily drawn to scale. For example, inductively uncoupled conductors 114, 116 are shown as spaced apart from one another about as far as closely inductively coupled conductors 138, 140 are from one another, which would not be the case if these distances were drawn to scale in FIG. 2.

First ends 114*a*, 116*a* of respective conductors 114, 116 may be connected at a connection 144 to a single conductor 146. Conductor 146 may be connected to or may form first node 102 of divider 100.

Again, the two grounded terminations of conductors 120, 122 provide a path for thermal energy to be removed from divider 100. The grounded terminations via the shields of transmission lines 128 and 130 provide a travel path that may carry heat away from divider 100.

In an embodiment of a two section design including a single, quarter-wavelength uncoupled divider section 108, bridging assembly 118, and a single, quarter-wavelength coupled divider section 132, a three to one bandwidth can be achieved at relatively high frequencies (e.g., 1.0-3.0 GHz, or 2.0-6.0 GHz).

Figure 3:
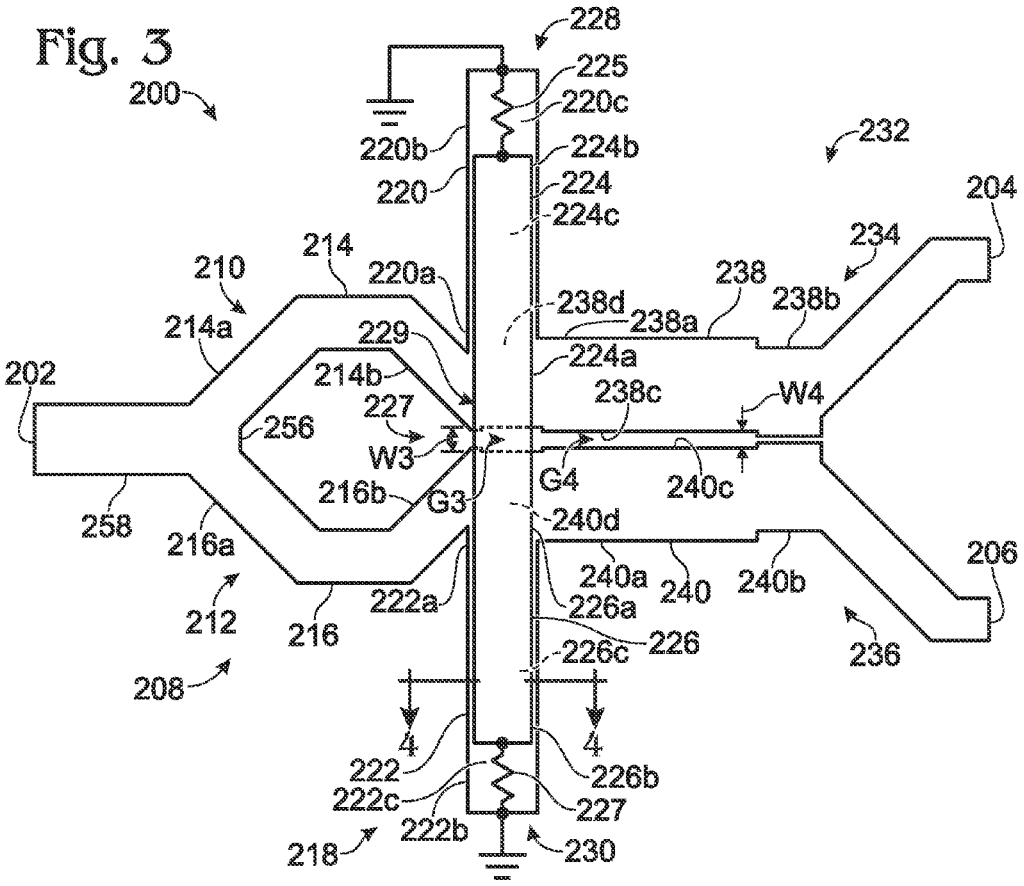
FIG. 3 is a semi-schematic plan view of a planar divider including an uncoupled divider section, an inductively broad-side coupled bridging assembly, and an inductively edge-side coupled divider section.

FIG. 3 shows a planar divider, generally indicated at 200. Divider 200 is an embodiment of divider 10 of FIG. 1. Divider 200 may include a first node 202, a second node 204, a third node 206, and a first uncoupled divider section 208 coupling node 202 to nodes 204, 206.

Divider section 208 may include associated transmission lines 210, 212. Transmission line 210 may include a planar conductor 214 and transmission line 212 may include a planar conductor 216. Conductors 214, 216 may be substantially inductively mutually uncoupled.

First ends 214*a*, 216*a* of respective conductors 214, 216 may be coupled to node 202. For example, first ends 214*a*, 216*a* may be directly connected to node 202. A second end 214*b* of conductor 214 may be coupled to node 204, and a second end 216*b* of conductor 216 may be coupled to node 206.

Divider 200 may include a bridging assembly 218 including planar conductors 220, 222, 224, 226 and resistors 225, 227. Impedances of resistors 225, 227 may be substantially equal to one another. A first end 220*a* of conductor 220 may be connected to second end 214*b* of conductor 214 in a connection region 227. A first end 222*a* of conductor 222 may be connected to second end 216*b* of conductor 216 in the connection region. A first end 224*a* of conductor 224 may be connected to a first end 226*a* of conductor 226. Accordingly, conductors 224 and 226 may form a continuous conductor 229. Second ends 220*b*, 222*b* of respective conductors 220, 222 may be grounded, and second ends 224*b*, 226*b* of respective conductors 224, 226 may be terminated to ground by respective resistors 225, 227.

Figure 4:
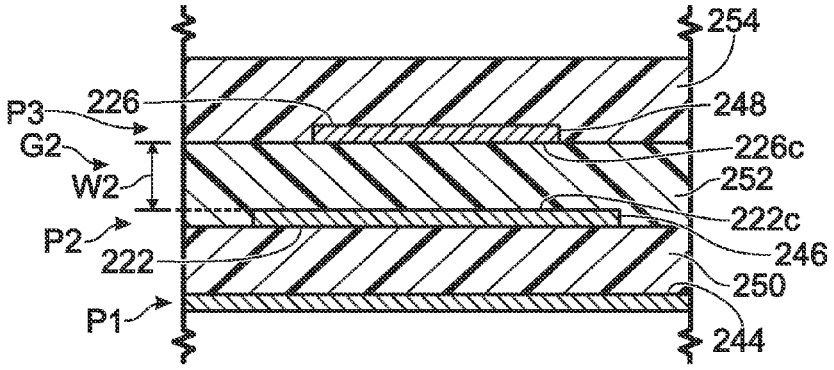
FIG. 4 is a cross-sectional view of the divider of FIG. 3 taken along line 4-4.

Conductors 220, 224 may be closely inductively mutually coupled, and conductors 222, 226 may be closely inductively mutually coupled. For example, conductors 220, 224 may be inductively broad-side coupled to one another (e.g., with a coupling coefficient of at least 0.15, and in some embodiments up to 0.5), and conductors 222, 226 may be inductively broad-side coupled to one another, e.g., with a coupling coefficient of at least 0.10, and preferably about 0.15 or more. In some embodiments a coupling coefficient of about 0.5 may be used. In particular, as can be seen in FIGS. 3 and 4, conductors 222, 226 may have respective broad sides (or broad surfaces) 222*c*, 226*c* that are spaced apart from and facing one another to define a gap G2 there between having a width W2 that is sufficiently narrow such that conductors 222, 226 are inductively mutually broad-side coupled to one another. Similarly, conductors 220, 224 (see FIG. 3) may have respective broad sides 220*c*, 224*c* that are spaced apart from and facing one another to define a gap, the same as gap G2 in this example, there between having a width that is sufficiently narrow such that conductors 220, 224 are inductively mutually broad-side coupled to one another. The width of the gap defined between broad sides 220*c*, 224*c* of respective conductors 220, 224 may be similar (or equal) to width W2.

Conductors 220, 224 may form a transmission line 228, and conductors 222, 226 may form a transmission line 230.

Conductors 220, 222 may extend in divergent directions. For example, as shown in FIG. 3, conductor 220 from first end 220*a* to second end 220*b* may extend away from conductor 222 in a first direction, and conductor 222 from first end 222*a* to second end 222*b* may extend away from conductor 220 in a second direction opposite to the first direction. First ends 220*a*, 222*a* of respective conductors 220, 222 may be spaced apart to define a gap G3 there between. Gap G3 may have a width W3 that may be sufficiently narrow to provide inductive mutual edge-side coupling between conductor ends 220*a*, 222*a*. Conductor 220 may have a longer length than conductor 224. Similarly, conductor 222 may have a longer length that conductor 226. For example, second end 220*b* of conductor 220 may extend past second end 224*b* of conductor 224, and second end 222*b* of conductor 222 may extend past second end 226*b* of conductor 226, as shown in FIG. 3. Also, as shown in FIG. 3, conductor 220 may have a wider width than conductor 224, and conductor 222 may have a wider width than conductor 226.

Divider 200 may include a second divider section 232 coupled to divider section 208 and bridging assembly 218 in connection region 227. Divider section 232 may couple divider section 208 to nodes 204, 206. For example, divider section 232 may include associated transmission lines 234, 236. Transmission line 234 may include a planar conductor 238 that couples second end 214*b* of conductor 214 and conductor end 220*a* to node 204, and transmission line 236 may include a planar conductor 240 that couples second end 216*b* of conductor 216 and conductor end 222*a* to node 206. For example, a first end 238*a* of conductor 238 may be connected to second end 214*b* of conductor 214 and conductor end 220*a*, a second end 238*b* of conductor 238 may be connected to node 204, a first end 240*a* of conductor 240 may be connected to second end 216*b* of conductor 216 and conductor end 222*a*, and a second end 240*b* of conductor 240 may be connected to node 206. It will be appreciated that the portions of conductor ends 220*a*, 222*a* directly facing conductor ends 224*a*, 226*a* may also be considered as portions of conductor ends 238*a*, 240*a*.

Conductors 238, 240 may be closely inductively mutually coupled. For example, conductors 238, 240 may be inductively edge-side coupled to one another (e.g., with a coupling coefficient of at least 0.10, and preferably greater than 0.15, and in some embodiments up to 0.5). In particular, conductors 238, 240 may have respective edges 238*c*, 240*c* that are spaced apart from one another to define a gap G4 there between having a width W4. Width W4 may be sufficiently narrow such that conductors 238, 240 are inductively mutually edge-side coupled to one another. As shown in FIG. 3, width W4 may decrease from a region proximal bridging assembly 218 to a region proximal nodes 204, 206. For example, width W4 may be wider between first ends 238*a*, 240*a* and the same as width W3, narrower in an intermediate region, and even narrower between second ends 238*b*, 240*b*. As result, the coupling coefficient along divider section 232 may vary along its length. In this example, the coupling coefficient of the inductive coupling between conductors 238, 240 in the region proximal nodes 204, 206 is higher as compared to the region proximal bridging assembly 218.

FIG. 4 shows a cross-section of divider 200 taken along the line 4-4 in FIG. 3. As shown, divider 200 may include a conductive ground layer 244 extending in a first plane P1.

Conductors 214, 216, 220, 222, 224, 226, 238, 240 (see FIG. 3) may be included in one or more conductive layers extending in one or more planes. The one or more planes may be parallel to and spaced apart from first plane P1. For example, conductors 214, 216, 220, 222, 238, 240 may be included in a first conductive layer 246 (see FIG. 4) extending in a second plane P2, and conductors 224, 226 may be included in a second conductive layer 248 extending in a third plane P3. Plane P2 may be parallel to and spaced apart from plane P1. Plane P2 may be parallel to and spaced apart from plane P3. Plane P3 may be parallel to and spaced apart from plane P1. As shown in FIG. 4, plane P2 may be disposed between plane P1 and plane P3.

A dielectric layer 250 may be disposed between conductive layers 244, 246. A dielectric layer 252 may be disposed between conductive layers 246, 248. A dielectric layer 254 may be disposed on layer 248 opposite layers 244, 246. Dielectric layers 250, 252, 254 may electrically conductively insulate the conductive layers from one another.

Second ends 220*b*, 222*b* (see FIG. 3) of respective conductors 220, 222 may be grounded to conductive ground layer 244 (see FIG. 4), second end 224*b* of conductor 224 may be electrically connected to conductive ground layer 244 by resistor 225, and second end 226*b* of conductor 226 may be electrically connected to conductive ground layer 244 by resistor 227. For example, vias may be formed through dielectric layer 250 to provide electrically conductive pathways from second ends 220*b*, 222*b* to conductive ground layer 244, and through dielectric layers 250, 252 to provide electrically conductive pathways from resistors 225, 227 to conductive ground layer 244.

Referring back to FIG. 3, first ends 214*a*, 216*a* of respective conductors 214, 216 may be connected at a connection 256 to a single conductor 258. Conductor 258 may be included in conductive layer 246. Conductor 258 may be connected to or may form first port 202 of divider 200.

In FIG. 3, coupled pairs of conductors 220, 224, forming transmission line 228, and 222, 226, forming transmission line 230, are shown extending rectilinearly in opposite directions. In some embodiments, coupled pairs of conductors 220, 224 and 222, 226 may extend in other configurations. For example, they may be curved or may be meandered, with conductors 220, 224 and conductors 222, 226 meandering together to maintain desired levels of coupling.

In some embodiments, conductor 224 may extend in plane P2 adjacent to conductor 220, and conductor 226 may extend in plane P2 adjacent to conductor 222. In which case, conductor 224 may be closely inductively edge-side coupled to conductor 220, and conductor 226 may be closely inductively edge-side coupled to conductor 222. A bridging conductor (not shown) may extend in plane P3 and connect together first ends 224*a*, 226*a* of respective conductors 224, 226. For example, a first electrically conductive via may connect first end 224*a* in plane P2 with a first end of the bridging conductor in plane P3, and a second electrically conductive via may connect first end 226*a* in plane P2 with a second end of the bridging conductor in plane P3. The bridging conductor may be closely inductively broad-side coupled to conductors 238, 240. For example, the bridging conductor may be closely inductively broad-side coupled to first ends 238*a*, 240*a* of respective conductors 238, 240. In some embodiments, the bridging conductor may be closely inductively broad-side coupled to first ends 220*a*, 222*a* of respective conductors 220, 222 and/or to conductors 214, 216.

Figure 5:
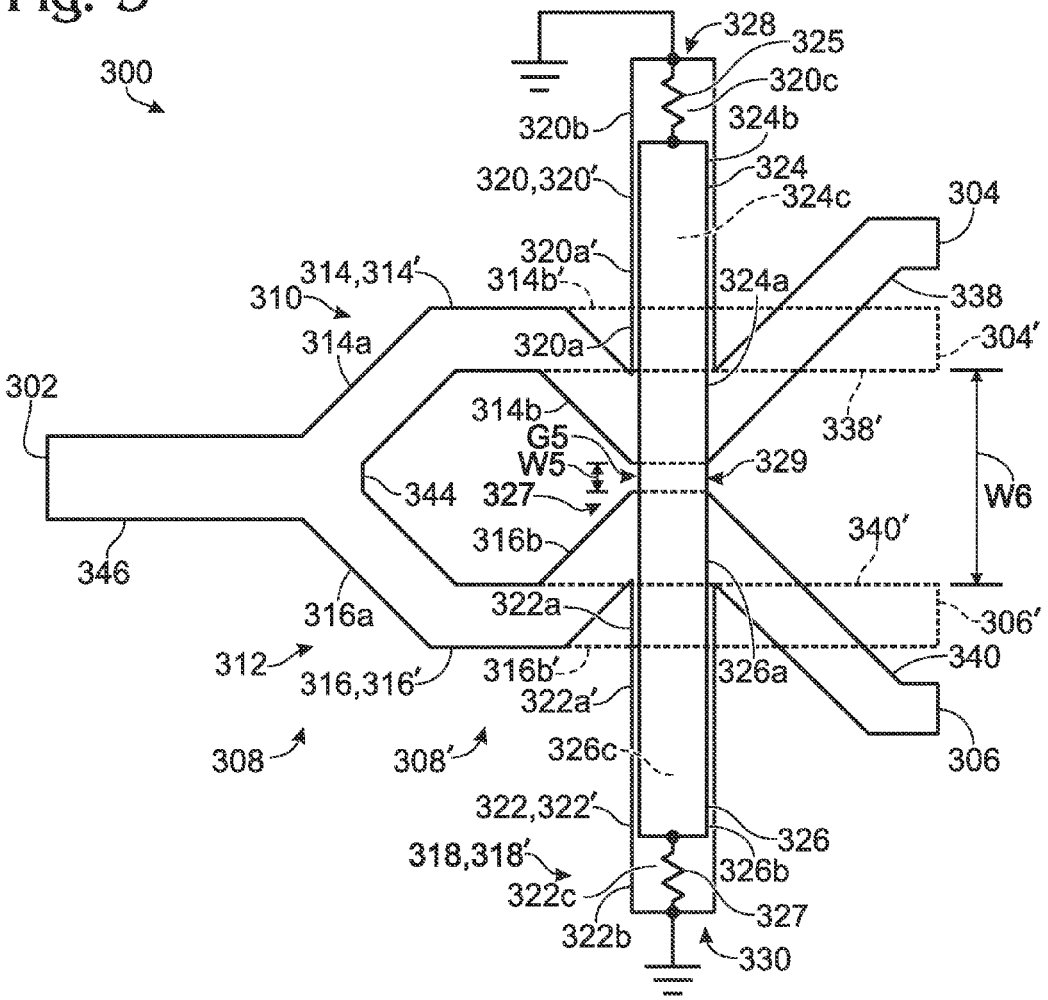
FIG. 5 is a semi-schematic plan view of a planar divider including an uncoupled first divider section, an inductively broad-side coupled bridging assembly, and a second divider section, with an optional configuration of the second divider section shown in dashed lines.

FIG. 5 shows a planar divider, generally indicated at 300. Divider 300 is an embodiment of divider 10 of FIG. 1 and is like divider 200 without coupled divider section 232. Divider 300 may include a first node 302, a second node 304, a third node 306, and an uncoupled divider section 308 coupling node 302 to nodes 304, 306.

Divider section 308 may include associated transmission lines 310, 312. Transmission line 310 may include a planar conductor 314 and transmission line 312 may include a planar conductor 316. Conductors 314, 316 may be substantially inductively mutually uncoupled.

First ends 314*a*, 316*a* of respective conductors 314, 316 may be coupled to node 302. For example, first ends 314*a*, 316*a* may be directly connected to node 302. A second end 314*b* of conductor 314 may be coupled to node 304, and a second end 316*b* of conductor 316 may be coupled to node 306.

Divider 300 may include a bridging assembly 318 including planar conductors 320, 322, 324, 326 and resistors 325, 327. Impedances of resistors 325, 327 may be substantially equal to one another. A first end 320*a* of conductor 320 may be connected to second end 314*b* of conductor 314 in a connection region 327. A first end 322*a* of conductor 322 may be connected to second end 316*b* of conductor 316 in connection region 327. A first end 324*a* of conductor 324 may be connected to a first end 326*a* of conductor 326, and may thereby form in combination a single continuous conductor 329. Second ends 320*b*, 322*b* of respective conductors 320, 322 may be grounded, and second ends 324*b*, 326*b* of respective conductors 324, 326 may be terminated to ground by respective resistors 325, 327.

Conductors 320, 324 may be closely inductively mutually coupled, and conductors 322, 326 may be closely inductively mutually coupled. For example, conductors 320, 324 may be inductively broad-side coupled to one another (e.g., with a coupling coefficient of at least 0.10, and preferably about 0.15 or more.), and conductors 322, 326 may be inductively broad-side coupled to one another (e.g., preferably with a coupling coefficient of 0.15 or more). In particular, conductors 320, 324 may have respective broad sides 320*c*, 324*c* that are spaced apart from and facing one another to define a gap there between having a width that is sufficiently narrow such that conductors 320, 324 are inductively mutually broad-side coupled to one another, as was discussed above for bridging assembly 218. Similarly, conductors 322, 326 may have respective broad sides 322*c*, 326*c* that are spaced apart from and facing one another to define a gap there between having a width that is sufficiently narrow such that conductors 322, 326 are inductively mutually broad-side coupled to one another. The width of the gap defined between broad sides 320*c*, 324*c* may be similar (or equal) to the width of the gap defined between broad sides 322*c*, 326*c*.

Conductors 320, 324 may form a transmission line 328, and conductors 322 and 326 may form a transmission line 330.

Conductor 320 may have a longer length than conductor 324. Similarly, conductor 322 may have a longer length that conductor 326. For example, second end 320*b* of conductor 320 may extend past second end 324*b* of conductor 324, and second end 322*b* of conductor 322 may extend past second end 326*b* of conductor 326, as shown in FIG. 5. Also, as shown in FIG. 5, conductor 320 may have a wider width than conductor 324, and conductor 322 may have a wider width than conductor 326.

Conductors 320, 322, and thereby transmission lines 328 and 330, may extend in divergent directions. For example, conductor 320 may extend from first end 320*a* to second end 320*b* in a first direction away from conductor 322. Similarly, conductor 322 may extend from first end 322*a* to second end 322*b* in a second direction away from conductor 320. In this example, the first direction is opposite to the second direction. First ends 320*a*, 322*a* of respective conductors 320, 322 may be spaced apart to define a gap G5 there between (i.e., between first end 320*a* and first end 322*a*) having width W5. Width W5 may be sufficiently narrow to provide close inductive mutual edge-side coupling between first ends 320*a*, 322*a* at bridging assembly 318.

A conductor 338 couples second end 314*b* of conductor 314 and end 320*a* of conductor 320 to node 304, and a conductor 340 couples second end 316*b* of conductor 316 and end 322*a* of conductor 322 to node 306.

Divider 300 may include a conductive ground layer (not shown, but similar to layer 244 in FIG. 4) extending in a first plane (similar to plane P1 in FIG. 4). Conductors 314, 316, 320, 322, 324, 326, 338, 340 may be included in one or more conductive layers extending in one or more planes. The one or more planes may be parallel to and spaced apart from the first plane. For example, conductors 314, 316, 320, 322, 338, 340 may be included in a first conductive layer (similar to layer 246 in FIG. 4) extending in a second plane (similar to plane P2 in FIG. 4), and conductors 324, 326 may be included in a second conductive layer (similar to layer 248 in FIG. 4) extending in a third plane (similar to plane P3 in FIG. 4).

Dielectric material may be disposed between the conductive ground layer and the first conductive layer, and between the first and second conductive layers (similar to dielectric layer 250 between layers 244, 246 and dielectric layer 252 between conductive layers 246, 248 in FIG. 4). Second ends 320*b*, 322*b* of respective conductors 320, 322 may be grounded to the conductive ground layer, and second ends 324*b*, 326*b* of respective conductors 324, 326 may be electrically connected to the conductive ground layer by respective resistors 325, 327.

In some embodiments, conductor 324 may extend in the second plane adjacent to conductor 320, and conductor 326 may extend in the second plane adjacent to conductor 322. In such a case, conductor 324 may be closely inductively edge-side coupled to conductor 320, and conductor 326 may be closely inductively edge-side coupled to conductor 322. A bridging conductor (not shown) may extend in the third plane and electrically connect together first ends 324*a*, 326*a* of respective conductors 324, 326. For example, a first electrically conductive via may connect first end 324*a* in the second plane with a first end of the bridging conductor in the third plane, and a second electrically conductive via may connect first end 326*a* in the plane with a second end of the bridging conductor in the third plane. The bridging conductor may be closely inductively broad-side coupled to ends 320*a*, 322*a* of conductors 320, 322. In some embodiments, the bridging conductor may be closely inductively broad-side coupled to ends of respective conductors 3238, 340 and/or to conductors 314, 316.

First ends 314*a*, 316*a* of respective conductors 314, 316 may be connected at a connection 344 to a single conductor 346. Conductor 346 may be included in the first conductive layer. Conductor 346 may be connected to or may form first port 302 of divider 300.

As shown in solid lines in FIG. 5, second ends 314*b*, 316*b* of respective conductors 314, 316 may extend toward one another near connection region 327.

A variation of divider 300 is shown in dashed lines in FIG. 5. In this embodiment, second ends 314*b*', 316*b*' of respective conductors 314', 316' of an uncoupled divider section 308' may extend in uncoupled spaced relationship to a modified bridging assembly 318' in a connection region 327'. Conductors 338, 340 may extend in a similar spaced relationship from the bridging assembly to nodes 304', 306'. For example, conductors 338, 340 may be spaced apart from one another by a width W6 corresponding to the width of conductor ends 314*b*', 316*b*'. Width W6 may be sufficiently wide to provide for conductor pairs 314', 316' and 338, 340 to be substantially inductively mutually uncoupled.

First ends 320*a*', 322*a*' of respective bridging assembly conductors 320', 322' may also be spaced apart to define a gap having width W6, in which case first ends 320*a*, 322*a* may be substantially inductively mutually uncoupled. However, in some embodiments, first ends 320*a*, 322*a* may be spaced apart to define gap G5 having width W5 even though first ends 338*a*, 340*a* may be spaced apart by width W6.

Transmission lines 328, 330 may be described as bridging transmission lines. If proximal ends of these bridging transmission lines are spaced apart, such as by a width W6, then there may either be an exposed conductor bridging the gap having width W6, or the split (e.g., the gap between the first ends of the respective conductor ends 320*a*', 320*b*' may occur at the middle of the gap separating the ends of the bridging transmission lines. The proximate conductor ends 320*a*, 320*b*, that would be extending into the gap having width W6 beyond conductor ends 314*b*', 316*b*' may effectively be capacitive stubs above ground. In either case, this may add some inductance in series with the bridging coaxial transmission line to the terminations. The stubs may be tuned out by shortening the uncoupled lines or the bridging transmission lines to ground. However, the series lines may already be at a high impedance, and the added capacitance of the stubs may be difficult to tune out with practical printed circuit board lines. For example, the tuned printed circuit lines may be very narrow, and may not be able to carry much power. Also, the coaxial transmission lines may be physically short, and may introduce complications at microwave frequencies (e.g., 3 GHz). Also, the hanging stubs may reduce bandwidth, but even so, it is expected that 20-30% bandwidth may be achieved.

Figure 6:
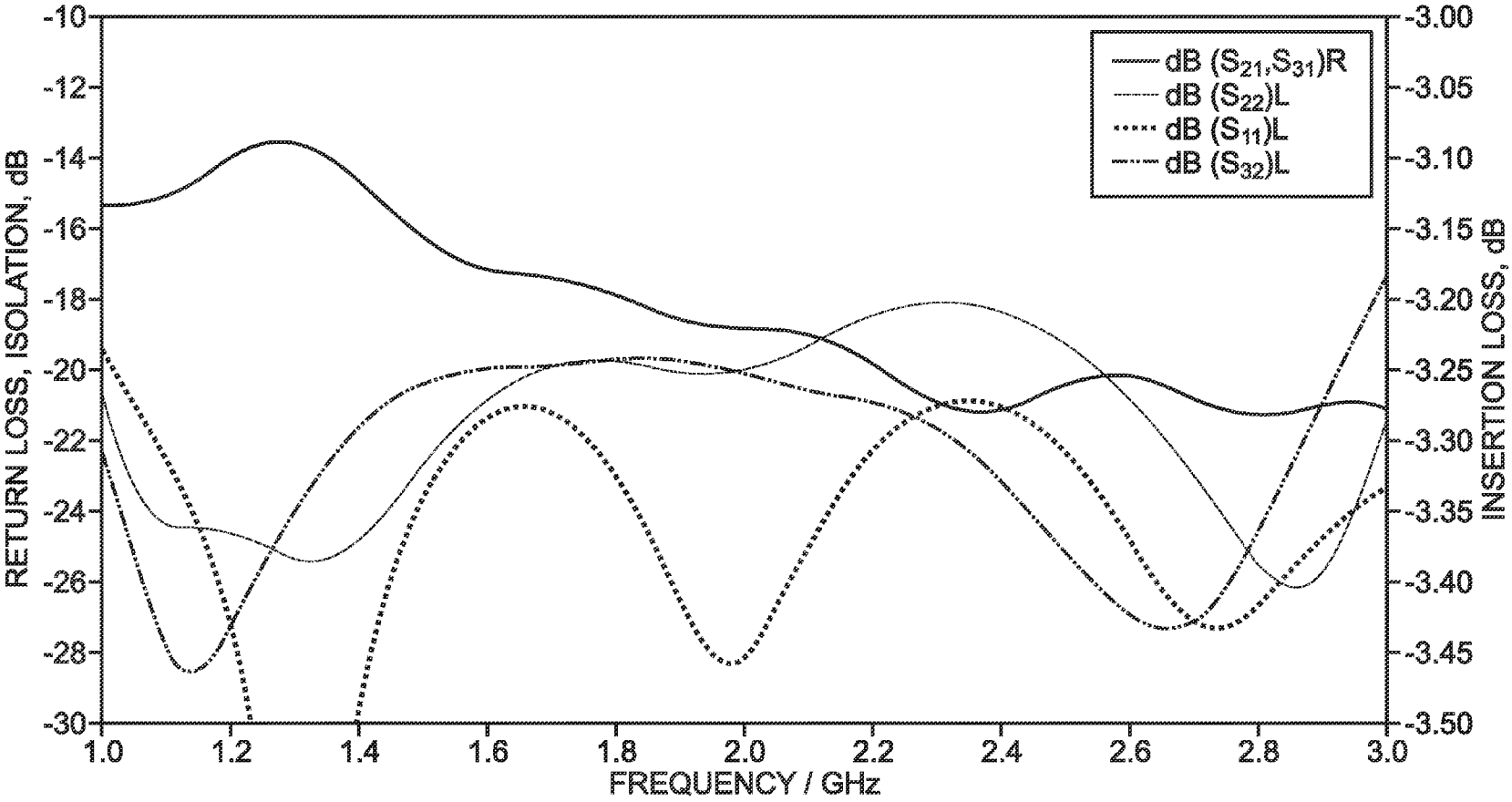
FIG. 6 is a chart illustrating a simulated performance of one embodiment of the divider of FIG. 3.

FIG. 6 illustrates a graph of a simulated performance of divider 200 of FIG. 3. Nodes 202, 204 and 206 are identified as nodes 1, 2 and 3, respectively. The letters "R" and "L" in the legend indicate the "right" or "left" axis for the associated performance variable. It is seen that the insertion loss ($S_{21}$ and $S_{31}$) ranges from about −3.08 dB to −3.28 dB over a pass band having a frequency range of 1.0 GHz to 3.0 GHz. Also, the reflection coefficient or return loss at node 202 ($S_{11}$), the return loss at node 204 ($S_{22}$), and the isolation between ports 204, 206 ($S_{32}$) are all less than −20 dB over most of this 1:3 bandwidth.

The above description is intended to be illustrative and not restrictive. Many other embodiments will be apparent to those skilled in the art, upon reviewing the above description. The scope of the inventions should therefore be determined with reference to the appended claims, along with the full scope of equivalents to which such claims are entitled. Accordingly, while several embodiments of a divider have been particularly shown and described, many variations may be made therein. This disclosure may include one or more independent or interdependent inventions directed to various combinations of features, functions, elements and/or properties, one or more of which may be defined in the following claims. Other combinations and sub-combinations of features, functions, elements and/or properties may be claimed later in this or a related application. Such variations, whether they are directed to different combinations or directed to the same combinations, whether different, broader, narrower or equal in scope, are also regarded as included within the subject matter of the present disclosure.

An appreciation of the availability or significance of claims not presently claimed may not be presently realized. Accordingly, the foregoing embodiments are illustrative, and no single feature or element, or combination thereof, is essential to all possible combinations that may be claimed in this or a later application. Each claim defines an invention disclosed in the foregoing disclosure, but any one claim does not necessarily encompass all features or combinations that may be claimed. Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated. Ordinal indicators may be applied to associated elements in the order in which they are introduced in a given context, and the ordinal indicators for such elements may be different in different contexts.

INDUSTRIAL APPLICABILITY

The methods and apparatus described in the present disclosure are applicable to industries and systems using high frequency signals, such as used in telecommunications applications including audio, video and data communications, and broadcasting systems. Microwave power dividers are useful in a wide variety of instrumentation and system applications, such as feeding signals to multiple antennas. Power dividers can also be used to combine microwave signals by applying the signals to be combined to what would normally be considered the outputs of the divider. Combining signals in this manner may provide high output power from a plurality of semiconductor signal devices, such as amplifiers.

What is claimed is:

1. A divider comprising:

first, second, and third nodes;

at least a first divider section coupling the first node to the second and third nodes, the first divider section including associated first and second transmission lines, the first transmission line including a first conductor having first and second ends, the second transmission line including a second conductor having first and second ends, the first ends of the first and second conductors being directly connected to the first node, the second end of the first conductor being connected to the second node, and the second end of the second conductor being connected to the third node; and a first bridging assembly including first and second resistors, and third, fourth, fifth, and sixth conductors each having first and second ends, the first end of the third conductor being directly connected to the second end of the first conductor, the first end of the fourth conductor being directly connected to the second end of the second conductor, the first end of the fifth conductor being directly connected to the first end of the sixth conductor, the second ends of the third and fourth conductors being grounded, the second end of the fifth conductor being terminated to ground by the first resistor, the second end of the sixth conductor being terminated to ground by the second resistor, the third and fifth conductors being closely inductively mutually coupled, and the fourth and sixth conductors being closely inductively mutually coupled.

2. The divider of claim 1, wherein the third conductor is an outer conductive shield of a first coaxial transmission line portion, the fifth conductor is an inner conductor of the first coaxial transmission line portion, the fourth conductor is an outer conductive shield of a second coaxial transmission line portion, and the sixth conductor is an inner conductor of the second coaxial transmission line portion.

3. The divider of claim 2, wherein the inner conductors of the first and second coaxial transmission line portions are sections of a continuous inner conductor that spans a gap defined between the outer conductive shields of the first and second coaxial transmission line portions.

4. The divider of claim 1, further comprising a conductive ground layer extending in a first plane, wherein the first, second, third, fourth, fifth, and sixth conductors are included in one or more conductive layers extending in one or more planes parallel to and spaced apart from the first plane.

5. The divider of claim 4, wherein the second ends of the third and fourth conductors are grounded to the conductive ground layer, the second end of the fifth conductor is electrically connected to the conductive ground layer by the first resistor, and the second end of the sixth conductor is electrically connected to the conductive ground layer by the second resistor.

6. The divider of claim 1, wherein the third and fifth conductors form a third transmission line, the fourth and sixth conductors form a fourth transmission line, and the first, second, third, and fourth transmission lines have respective impedances that are configured to provide substantially equal output signals on the second and third nodes for a given input signal having a given frequency input on the first node.

7. A divider comprising:

first, second, and third nodes;

at least a first divider section coupling the first node to the second and third nodes, the first divider section including associated first and second transmission lines, the first transmission line including a first conductor having first and second ends, the second transmission line including a second conductor having first and second ends, the first ends of the first and second conductors being coupled to the first node, the second end of the first conductor being coupled to the second node, and the second end of the second conductor being coupled to the third node;

a first bridging assembly including first and second resistors, and third, fourth, fifth, and sixth conductors each having first and second ends, the first end of the third conductor being connected to the second end of the first conductor, the first end of the fourth conductor being connected to the second end of the second conductor, the first end of the fifth conductor being connected to the first end of the sixth conductor, the second ends of the third and fourth conductors being grounded, the second end of the fifth conductor being terminated to ground by the first resistor, the second end of the sixth conductor being terminated to ground by the second resistor, the third and fifth conductors being closely inductively mutually coupled, and the fourth and sixth conductors being closely inductively mutually coupled;

a conductive ground layer extending in a first plane;

a first conductive layer, including the first, second, third, and fourth conductors, extending in a second plane parallel to and spaced apart from the first plane; and a second conductive layer, including the fifth and sixth conductors, extending in a third plane parallel to the second plane and spaced apart from the first plane.

8. The divider of claim 7, wherein the second plane is disposed between the first and third planes.

9. A divider comprising:

first, second, and third nodes;

a plurality of divider sections including a first divider section and a second divider section, the first divider section coupling the first node to the second divider, the first divider section including associated first and second transmission lines, the first transmission line including a first conductor having first and second ends, the second transmission line including a second conductor having first and second ends, the first ends of the first and second conductors being coupled to the first node, the second end of the first conductor being coupled to the second node, and the second end of the second conductor being coupled to the third node, and the second divider section coupling the first divider section to the second and third nodes, the second divider section including associated third and fourth transmission lines, the third transmission line including a seventh conductor that couples the second end of the first conductor to the second node, the fourth transmission line including an eighth conductor that couples the second end of the second conductor to the third node; and a first bridging assembly including first and second resistors, and third, fourth, fifth, and sixth conductors each having first and second ends, the first end of the third conductor being connected to the second end of the first conductor, the first end of the fourth conductor being connected to the second end of the second conductor, the first end of the fifth conductor being connected to the first end of the sixth conductor, the second ends of the third and fourth conductors being grounded, the second end of the fifth conductor being terminated to ground by the first resistor, the second end of the sixth conductor being terminated to ground by the second resistor, the third and fifth conductors being closely inductively mutually coupled, and the fourth and sixth conductors being closely inductively mutually coupled.

10. The divider of claim 9, wherein the first and second conductors are substantially inductively mutually uncoupled and the seventh and eighth conductors are closely inductively mutually coupled.

11. The divider of claim 10, wherein the third and fourth conductors extend in divergent directions, the first ends of the third and fourth conductors being spaced apart to define a first gap therebetween, the seventh and eighth conductors being spaced apart and having a second gap therebetween, the first gap having a width that corresponds with a width of the second gap.

12. The divider of claim 10, wherein the first bridging assembly is located between the first and second divider sections.

13. The divider of claim 10, wherein the first end of the third conductor is connected to the second end of the first conductor in a junction region where the first divider section is joined to the second divider section.

14. The divider of claim 13, wherein the first end of the fourth conductor is connected to the second end of the second conductor in the junction region.

15. The divider of claim 10, wherein the third and fourth conductors are respective first and second conductive shield portions of a coaxial transmission line, and the fifth and sixth conductors are respective first and second inner conductor portions of the coaxial transmission line.

16. The divider of claim 15, wherein adjacent ends of the first and second conductive shield portions are spaced apart from one another to define a gap therebetween that electrically conductively isolates the first and second conductive shield portions from one another.

17. The divider of claim 10, further comprising a conductive ground layer extending in a first plane, wherein the first, second, third, fourth, seventh, and eighth conductors are included in a first conductive layer extending in a second plane, the fifth and sixth conductors are included in a second conductive layer extending in a third plane, the second ends of the third and fourth conductors are grounded to the conductive ground layer, the second end of the fifth conductor is electrically connected to the conductive ground layer by the first resistor, and the second end of the sixth conductor is electrically connected to the conductive ground layer by the second resistor.

18. The divider of claim 17, wherein a first end of the seventh conductor is connected to the second end of the first conductor, a second end of the seventh conductor is connected to the second node, a first end of the eighth conductor is connected to the second end of the second conductor, a second end of the eighth conductor is connected to the third node, and the fifth and sixth conductors form a continuous conductor that is broad-side coupled to the first ends of the seventh and eight conductors.

19. The divider of claim 17, wherein the third and fifth conductors are inductively broad-side coupled to one another with a coupling coefficient of at least 0.15, and the seventh and eighth conductors are inductively edge-side coupled to one another with a coupling coefficient of at least 0.15.

* * * * *